United States Patent [19]

Carlson et al.

[11] Patent Number: 4,577,839

[45] Date of Patent: Mar. 25, 1986

[54] REFRACTORY INSULATOR BLANKET AND COVER

[75] Inventors: Robert A. Carlson, Northbrook, Ill.; Nicholas H. Smith, Chesterton, Ind.

[73] Assignee: Reptech, Inc., Nortfield, Ill.

[21] Appl. No.: 569,032

[22] Filed: Jan. 9, 1984

[51] Int. Cl.[4] ..... C21C 5/48

[52] U.S. Cl. ..... 266/272; 266/280; 266/287

[58] Field of Search ..... 428/605, 608, 621; 266/280, 287, 271, 283, 903, 272, 282, 284, 285, 286; 501/95

[56] References Cited

U.S. PATENT DOCUMENTS

| | | | |
|---|---|---|---|
| 3,948,295 | 4/1976 | Lemont et al. | 428/608 |
| 4,338,380 | 7/1982 | Erickson et al. | 428/621 |
| 4,390,170 | 6/1983 | Schaefer et al. | 266/271 |
| 4,424,956 | 1/1984 | Grant et al. | 266/287 |

*Primary Examiner*—L. Dewayne Rutledge
*Assistant Examiner*—S. Kastler
*Attorney, Agent, or Firm*—Kinzer, Plyer, Dorn & McEachran

[57] ABSTRACT

A light weight insulator blanket capable of repetitive use of extended duration as a cover, gasket, or the like for a vessel or conduit used in transporting, storing or processing molten or non-molten metal, particularly iron or steel, and in similar applications, including a principal insulator layer of a light weight, flexible, fibrous ceramic material having one or both surfaces covered by a thick protective layer of a light weight, flexible fibrous metallic material such as high-temperature stainless steel wool, monel metal wool, or a multilayer knitted or woven material; the layers are securely bound to each other by metallic fastening means such as high temperature stainless steel wire stitching, staples, or rivets.

48 Claims, 10 Drawing Figures

Fig. 1.
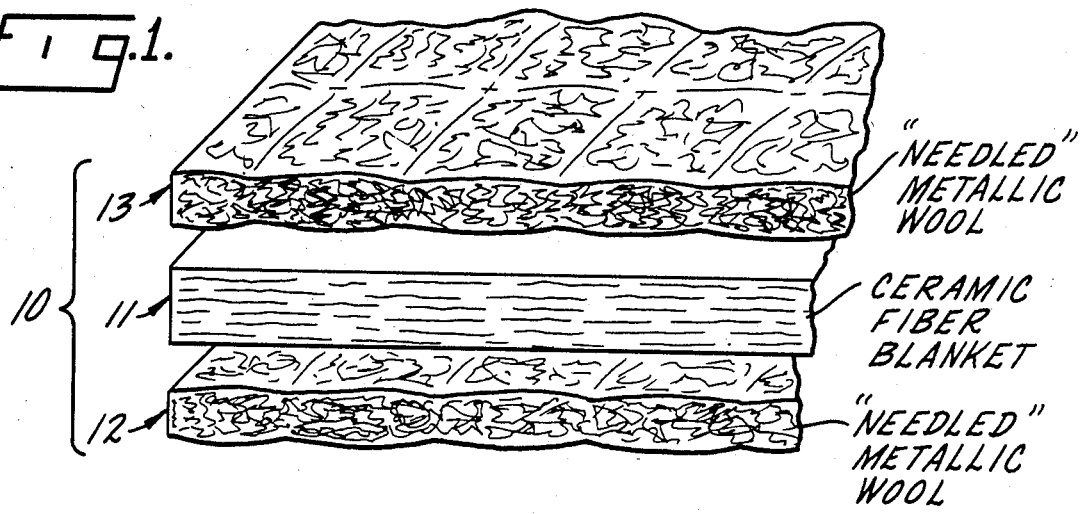
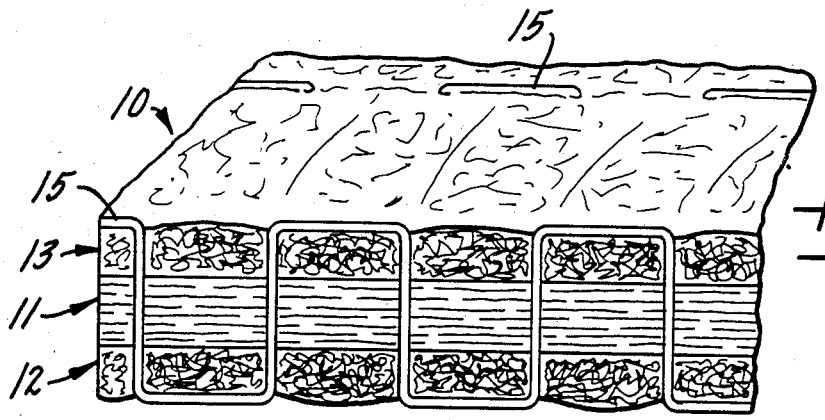
Fig. 2.
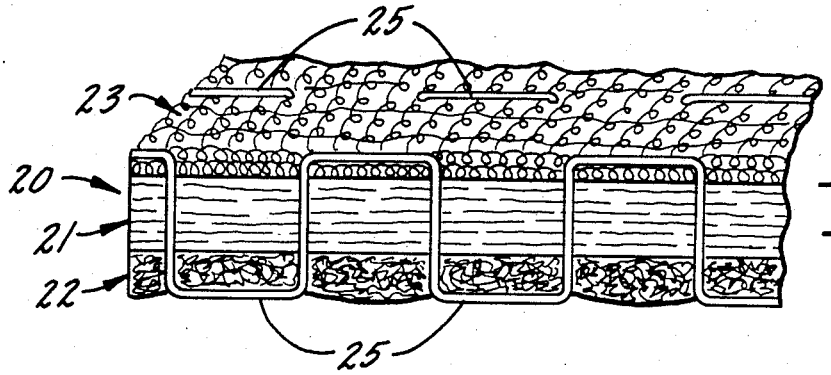
Fig. 3.
Fig. 4.
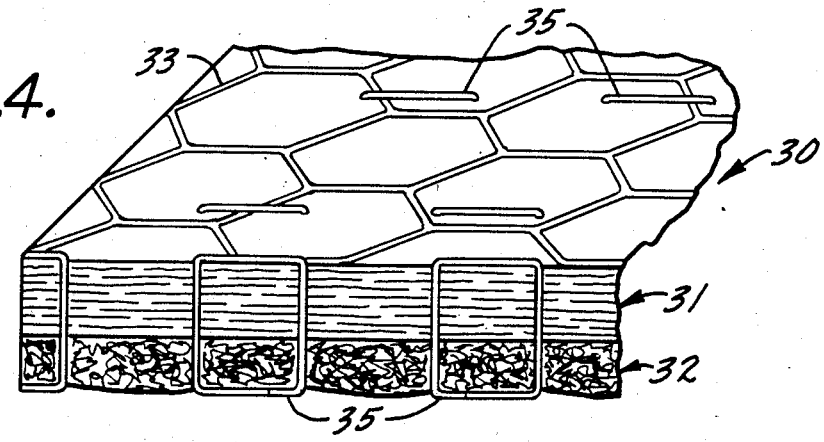

REFRACTORY INSULATOR BLANKET AND COVER

BACKGROUND OF THE INVENTION

In blast furnaces, steel mills, iron and steel foundries, and other similar facilities a variety of different ladles and other vessels and conduits are required for transporting, processing, and storing molten or near-molten metal at temperatures in excess of 1600° F., the metal temperature sometimes exceeding 3000° F. In many instances, the molten metal is accompanied by at least limited quantities of slag. In the past, and even up to the present time, many of these transportation and storage vessels and conduits have been left open to the atmosphere, often producing substantial undesirable emissions and surface chemical reactions. Open vessels and conduits also result in high heat losses having an adverse economic impact on operation of the facilities in which they are employed. Another problem encountered in facilities of this kind is the solidification of metal remaining in vessels or conduits after they have been drained, with a consequent loss of capacity. Yet another problem for such vessels and conduits results from thermal shock to the refractory lining if the vessel or conduit is drained and remains empty and open to the atmosphere for a substantial period of time prior to re-use.

In some blast furnaces, steel mills, foundries, and like facilities, the foregoing problems pertaining to undesirable emissions, heat losses, thermal shock, and metal solidification are reduced by providing covers for the vessels and conduits. For the most part, these covers have been of rigid construction and have included refractory linings facing the interiors of the vessels or conduits. These covers have generally been quite heavy, so that they cannot be removed or replaced manually. As a consequence, a crane or hoist is required to remove such a cover for filling or emptying a ladle, tundish or other vessel or for repair and maintenance of a trough, runner, or similar conduit. Another problem with rigid covers is the necessity of maintaining a refractory insulator lining in place on the lower surface of the cover; any fastening means for the refractory lining tends to deteriorate with continued use, which may lead to all or part of the refractory lining dropping into the vessel or conduit with consequent contamination of the metal.

Attempts have been made to meet these difficulties through the use of covers of light weight, flexible, fibrous ceramic insulator materials sometimes referred to as ceramic "blankets". Thus, for a vessel used for the transportation of molten iron or steel, it has been known to place a ceramic blanket over the inlet opening of the vessel and to maintain that blanket in place while the vessel is used to transport the molten metal. A ceramic blanket of this kind, however, is relatively fragile, at least in comparison with other devices used in a blast furnace, steel mill, foundry, or similar environment. Thus, the ceramic blanket is subject to devitrification when directly exposed to the interior of a vessel or conduit containing molten iron or steel for an extended period of time. The ceramic blanket is also likely to be severely damaged if contacted by any of the molten metal.

The surface of a ceramic blanket is also quite subject to abrasion damage, and dimensional stability of the blanket material leaves much to be desired. In some instances, open mesh metal facings have been utilized on ceramic blankets of this kind, the mesh frequently being a type that resembles conventional chicken wire. A facing of this kind provides some improvement in the life of a ceramic blanket cover for a vessel or conduit used in the transportation or storage of molten metal, but even with such a facing, the ceramic blanket has a relatively short useful life, usually only a few hours. In this regard, the labor cost entailed in frequent replacement of the ceramic blanket can be substantial.

Thus, there is a major need for a light weight insulator cover capable of extended, repetitive use on a vessel or conduit employed in transporting, processing, or storing molten or near-molten metal as in a blast furnace, steel mill, foundry, or other like facility. Such a cover or cover material should be light enough in weight to permit effective positioning and removal of the cover by one man or at most by two men. The cover should not have the fragility of a conventional ceramic insulator blanket; that is, it should have good dimensional stability, should remain relatively unaffected by exposure of extended duration (e.g. several days to several weeks) to molten or near-molten metal, and should exhibit high resistance to deterioration from abrasion and other physical shocks occurring in the course of removal and replacement of the cover. At present, covers and cover materials having these characteristics are not available.

SUMMARY OF THE INVENTION

It is a principal object of the invention, therefore, to provide a new and improved light weight, flexible, insulator blanket capable of extended repetitive use as a cover, gasket, or wrapping for a very high temperature heat source such as a vessel or conduit employed in transporting, processing, or storing molten or near-molten metal at temperatures in excess of 1600° F.

A specific object of the invention is to provide a new and improved protective layer as a facing for a light weight flexible fibrous ceramic blanket to retard the effects of devitrification of the ceramic blanket and to protect the ceramic blanket against abrasion in the course of prolonged use as a cover for a ladle or other vessel containing molten iron or steel and in other similar applications, thereby greatly extending the useful life of the ceramic blanket.

Another object of the invention is to provide a new and improved cover for a vessel or conduit used in transporting, processing, or storing molten or near-molten metal, at temperatures in excess of 1600° F., that is sufficiently rigid to be self-supporting but light enough in weight to allow for positioning and removal of the cover by one or two men and that can be used repetitively over an extended period of time.

A specific object of the invention is to provide a new and improved light weight flexible composite insulator blanket which combines a flexible layer of fibrous ceramic insulator material with a protective layer of flexible fibrous metallic material and which is relatively inexpensive yet capable of extended repetitive use. "Fibrous metallic material", as used throughout this specification and in the appended claims, includes metallic wool, knitted and woven materials, and any other such material formed of metallic fibers.

Accordingly, in one aspect the invention relates to a light weight, flexible, composite insulator blanket capable of extended, reptitive use as a cover, wrapping or gasket for a very high temperature heat source comprising a vessel or conduit employed in transporting, processing, or storing molten or near-molten metal, at temperatures in excess of 1600° F. The insulator blanket comprises a principal insulator layer of a light weight, flexible, fibrous ceramic material subject to deterioration through devitrification and abrasion when subjected to prolonged exposure to a very high temperature heat source, a protective layer of light weight, flexible fibrous metallic material covering one surface of the principal insulator layer to a depth many times greater than the thickness of the metallic fibers, and fastening means securing the protective layer to the principal insulator layer at a multiplicity of locations throughout the surface area of the insulator blanket. In some applications, two protective layers are provided, one on each side of the ceramic layer.

In another aspect, the invention relates to a light weight insulator cover capable of repetitive use of extended duration on a very high temperature heat source comprising a vessel or conduit employed in transporting, processing, or storing molten or near-molten metal, at temperatures in excess of 1600° F. The cover comprises an open cover frame of metal tubing or rod, an insulator blanket, and suspension means suspending the insulator blanket from the cover frame. The insulator blanket includes a principal insulator layer of light weight, flexible, fibrous ceramic material, a protective layer of light weight, flexible fibrous metallic material covering one surface of the insulator layer to a depth many times the thickness of the metallic fibers, and fastening means securing the protective layer to the insulator layer. The insulator blanket is oriented to have its protective layer facing toward the heat source. Additional protective layers may be utilized.

BRIEF DESCRIPTION OF THE DRAWINGS

FIG. 1 is an exploded, partially sectional perspective view of three layers of material to be combined in the fabrication of a light weight, flexible, composite insulator blanket comprising one embodiment of the present invention;

FIG. 2 is a partially sectional perspective view of a composite insulator blanket incorporating the three layers shown in FIG. 1;

FIGS. 3, 4, 5 and 6 are partially sectional perspective views, similar to FIG. 2, illustrating three other embodiments of the composite insulator blanket of the invention;

DESCRIPTION OF THE PREFERRED EMBODIMENTS

Figure 5:
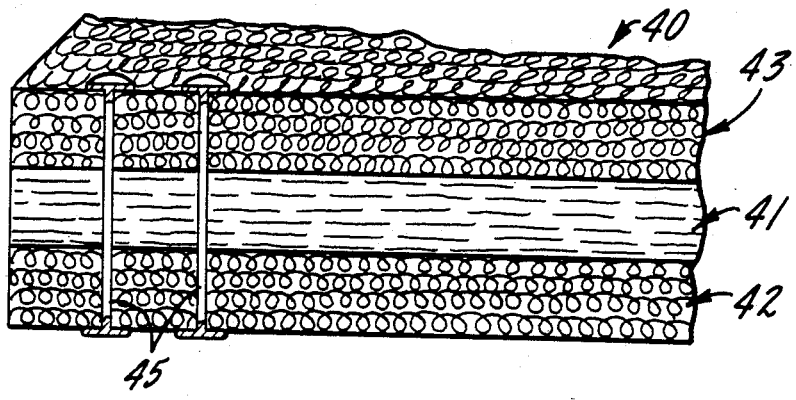

FIG. 1 illustrates the individual layers 11, 12 and 13 utilized in the fabrication of a light weight, flexible, composite insulator blanket 10 comprising one preferred embodiment of the present invention. Blanket 10 is shown in finished form in FIG. 2.

Blanket 10 comprises a principal insulator layer 11 formed of a light weight, flexible, fibrous ceramic material. Ceramic "blankets" of this kind are well known and commercially available. One source of a light weight flexible fibrous ceramic blanket material is Carborundum Co., which markets such materials with temperature ratings of 2400° F. and 2700° F., in densities of four, six, and eight pounds per cubic foot under the trade designation FIBERFRAX. Another material that may be utilized for the principal insulator layer 11 is available from Babcock & Wilcox Company under the trademark KAOWOOL. These ceramic blanket materials are quite flexible, have highly desirable insulation properties, and are quite light in weight; however, they are subject to relatively rapid deterioration through devitrification when subjected to prolonged exposure to a very high temperature heat source such as the interior of a vessel containing molten metal. Further, the ceramic blanket layer 11, by itself, is not satisfactory with respect to dimensional stability and is likely to be readily damaged due to abrasion or other physical or chemical shock.

Blanket 10 incorporates a first protective layer 12 of light weight, flexible fibrous metallic material that completely covers one surface of the principal insulator layer 11. The protective layer 12 is formed of a high temperature metallic wool, preferably a high temperature stainless steel, monel metal, or a mixture of the two. One specific stainless steel wool that has been found to afford excellent protective properties for very high temperature applications is made of a stainless steel closely similar to Type 446 high chromium stainless. Another stainless steel suitable for many applications is Type 304, having a high chromium and nickel content. The metallic wool of layer 12, FIGS. 1 and 2, is preferably "needled" at a multiplicity of locations throughout its surface to condense the thickness of the layer to a limited extent and afford improved dimensional stability. Needled metal wool is commercially available from several sources including Reptech, Inc., the assignee of this application.

The insulator blanket 10 of FIGS. 1 and 2 includes a second protective layer 13 on the opposite surface of insulator layer 11 from protective layer 12. This second protective layer 13 is again a needled metallic wool layer, corresponding fully in construction to layer 12. In a typical insulator blanket intended for extended repetitive use as a cover, gasket, or insulator wrapping for a very high temperature heat source such as a vessel or conduit employed in transporting, processing, or storing molten or near-molten metal, at temperatures in excess of 1600° F., the thickness of insulator layer 11 may be of the order of one inch or more and the thicknesses of the protective layers 12 and 13 may each be in the range of approximately 0.75 inch to one inch or more. The density of the metallic wool used for protective layers 12 and 13 may be of the order of 900 to 3,000 grams per square meter; some variation is permissible, depending upon the application.

To complete the composite insulator blanket 10, it is necessary to provide fastening means to secure protective layers 12 and 13 to the principal insulator layer 11. In the preferred construction shown in FIG. 2, this fastening means comprises a plurality of lines of stitching 15 which secure the protective layers 12 and 13 to the principal insulator layer 11 at a multiplicity of locations throughout the surface area of the insulator blanket 10. For a stitched blanket as illustrated in FIG. 2, the stitching 15 comprises a high temperature metal wire, preferably high temperature stainless steel. One wire suitable for this purpose is 0.01 to 0.5 mm. diameter wire of Type 304 stainless steel.

When the blanket 10 of FIG. 2 is utilized as a cover, gasket, or wrapping for a very high temperature heat source, such as a vessel or conduit employed in transporting, processing, or storing molten or near-molten metal, either of the two protective layers 12 and 13 may be disposed in facing relation to the hot metal; that is, blanket 10 is reversible. Each of the protective layers 12 and 13 affords effective mechanical protection for the relatively fragile ceramic insulator layer 11, preventing undue damage to the insulator layer through abrasion and other effects of mechanical contact with the vessel or other elements of the environment. The protective layer that faces the hot metal reflects an appreciable amount of radiant heat back toward its source. In this respect, the external layer 12 or 13 effectively prevents or at least materially reduces the rate of devitrification of the surface of the ceramic layer 11. In comparison with an unprotected ceramic blanket, the composite blanket 10 affords greatly improved dimensional stability and mechanical strength and toughness combined with substantial protection against surface degradation of ceramic layer 11 that might otherwise result from exposure to a high temperature source over a substantial period of time.

FIG. 3 illustrates another construction 20 for a light weight, flexible composite insulator blanket constructed in accordance with the invention. Blanket 20 again includes a principal insulator layer 21 of a light weight, flexible fibrous ceramic material, like layer 11 in blanket 10. One surface of layer 21, the surface that would face a high temperature heat source such as the interior of a vessel containing molten metal, is covered with a protective layer 22 of high temperature stainless steel wool; monel metal wool or high temperature carbon fiber wool may be used. Metal wire stitching 25 is used to fasten protective layer 22 and a second protective layer 23 onto the opposed surfaces of the ceramic blanket layer 21. The second protective layer 23 is a metallic knit or woven material formed of high temperature metallic wire, preferably high temperature stainless steel wire or monel metal wire. Blanket 20, unlike blanket 10, is not reversible; the metallic knit protective layer 23 provides adequate mechanical protection, at the elevated temperatures occurring on the reverse side of blanket 21 away from the high temperature source, but is too thin to afford extended protection against the devitrifying effects of exposure to the interior of a vessel containing molten metal or to a comparable high temperature source. The stitching wire 25 may be a high temperature stainless steel wire or a monel metal wire.

FIG. 4 illustrates a composite insulator blanket 30 comprising a further embodiment of the present invention. Blanket 30 includes a principal insulator layer 31 of light weight, flexible, fibrous ceramic material protected on one side by a thick layer 32 of high temperature stainless steel wool or monel metal wool, or other high temperature metallic wool. The other surface of the ceramic blanket material 31 is covered with an open metal mesh 33, which may comprise a "chicken wire" mesh of metal such as ordinary steel wire or a high temperature stainless steel or monel metal. Alternatively, mesh 33 may be a sheet of expanded metal. The three layers 31, 32, and 33 of blanket 30 are held together by fastening means constituting a multiplicity of staples 35 tying the three layers together at locations distributed throughout the surface area of the blanket. Staples 35, like the stitching wires 15 and 25 of the previously described embodiments, should be formed from a high temperature stainless steel wire or from monel metal or from other metallic wire having comparable heat resistant characteristics. Like the blanket 20 shown in FIG. 3, the blanket 30 of FIG. 4 is not reversible; the metallic wool protective layer 32 should be employed facing the high temperature heat source (e.g. molten or near-molten metal) in order to afford adequate protection for the ceramic insulator layer 31.

Yet another embodiment of a light weight, flexible, composite insulator blanket constructed in accordance with the invention is shown in FIG. 5. The blanket 40 of FIG. 5 includes a principal insulator layer 41, again comprising a light weight, flexible, fibrous ceramic blanket material. The opposite surfaces of layer 41 are covered with two protective layers 42 and 43. Each of the protective layers 42 and 43 comprises a plurality of layers of knitted material of high temperature stainless steel wire or monel metal wire, thick enough to afford thermal protection as well as mechanical protection to the adjacent surface of layer 41. In blanket 40 the requisite fastening means for securing the protective layers 42 and 43 to the principal insulator layer 41 comprises a multiplicity of rivets 45 formed of a high temperature metal, preferably a high temperature stainless steel or monel metal. Like blanket 10 of FIG. 2, the blanket 40 of FIG. 5 is reversible; either one of the two protective layers 42 and 43 can be positioned to face the high temperature source when the blanket is used as a cover, gasket, or wrapping.

Figure 6:
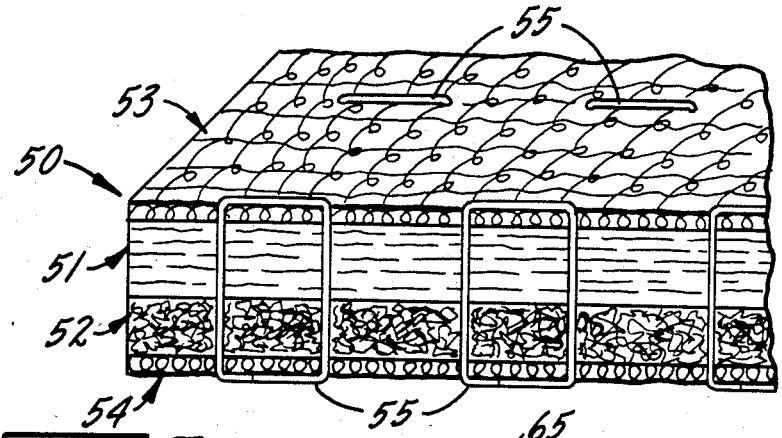

FIG. 6 illustrates a composite insulator blanket 50 constructed in accordance with still another embodiment of the present invention. Blanket 50 includes a main insulator layer 51 of fibrous ceramic material. The lower surface of the ceramic blanket 51 the surface that would face a heat source, is covered with a needled metallic wool protective layer 52. The opposite surface of the ceramic insulator layer 51 is covered with a relative thin knitted or woven high temperature metal layer 53. In addition, a similar thin knitted or woven metallic layer 54 is disposed in covering relation to the outer surface of the metallic wool layer 52. The entire blanket is held together by fastening means comprising a multiplicity of high temperature metallic wire staples 55. Blanket 50 is not reversible; the steel wool layer 52 should be on the side of the blanket facing the high temperature source. The knitted metallic layers 53 and 54 are utilized for mechanical protection.

The insulator blankets 10, 20, 30, 40 and 50 of FIGS. 1–6 use wire stitching, staples, and rivets as the fastening means. Of course, a combination of any two or even all three such fastening means can be used if desired.

Figure 7:
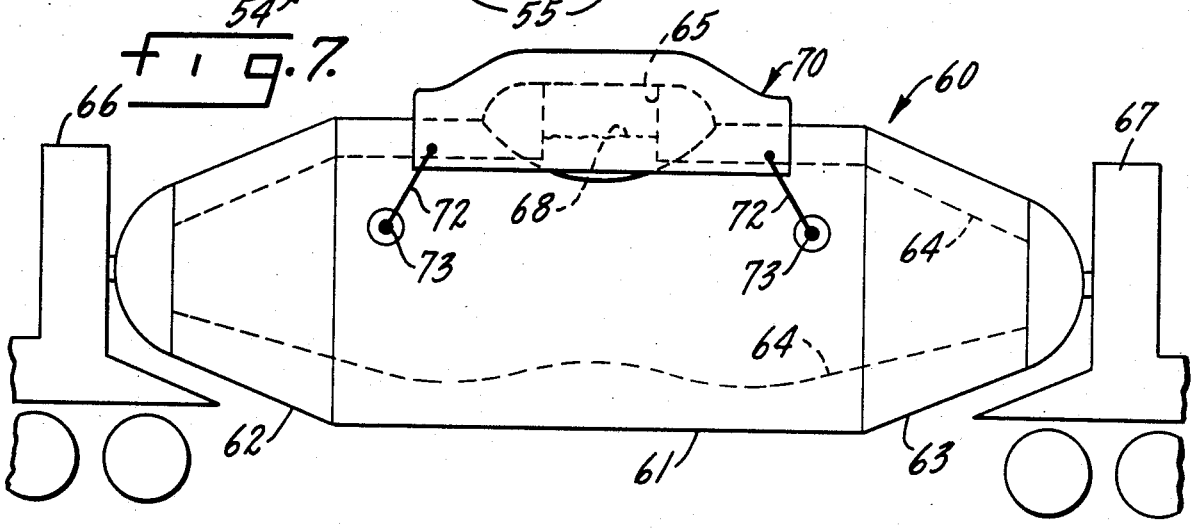
FIG. 7 is an elevation view of one form of ladle used for transportation of molten iron or steel and equipped with a cover formed of the blanket material of FIGS. 1 and 2.
Figure 8:
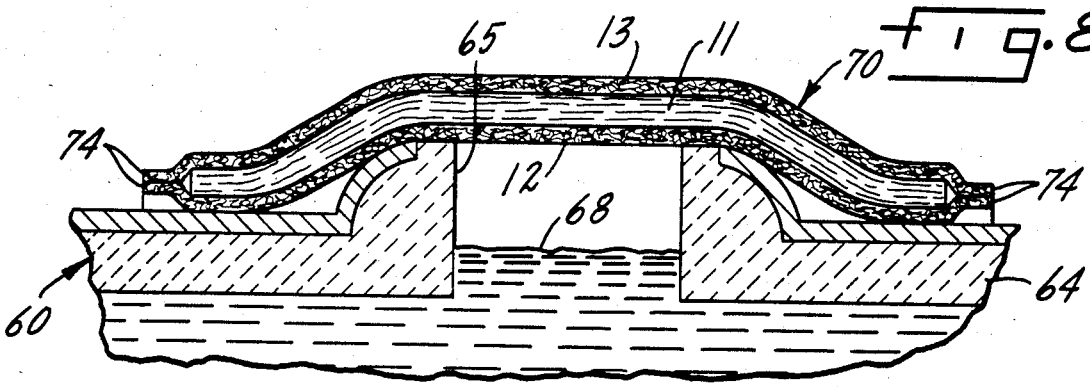
FIG. 8 is a longitudinal sectional view, on an enlarged scale, of the cover employed in FIG. 7.

FIGS. 7 and 8 illustrate an application in which a light weight, flexible, composite insulator blanket serves as a cover for a ladle 60 utilized for the transportation of molten iron or steel. Ladle 60 is a "submarine" type ladle, sometimes referred to as a Pugh ladle, having a steel shell that includes a central cylindrical portion 61 and two truncated conical end portions 62 and 63. The steel shell has an internal refractory lining 64. An opening 65 at the center of the cylindrical portion 61 is utilized for filling and draining ladle 60. The ladle is rotatably mounted on two trucks 66 and 67. The maximum fill level for the ladle is indicated at 68.

In FIGS. 7 and 8, ladle 60 is shown full of molten iron or steel up to level 68, as when used for transportation and short-term storage purposes. The inlet/outlet opening 65 is closed by a cover 70 which constitutes an insulator blanket that incorporates the construction shown in FIG. 2 for blanket 10. Blanket 70 may be held in place on ladle 60 by appropriate means such as a plurality of anchoring wires 71 secured to the blanket and releasably fastened to the ladle by appropriate clips or other similar means 73, not shown in detail. As shown in FIG. 8, the edges of the high temperature metallic wool protective layers 12 and 13 of blanket 70 may project beyond the edges of the ceramic blanket 11 that constitutes the main insulator layer of the cover. These edges 74 may be held together by appropriate means such as staples, stitching or spot welding.

In use, blanket 70 is placed over ladle opening 65 as promptly as possible after the ladle has been filled with molten metal 68. In a typical application, cover 70 is kept in place until ladle 60 is subsequently drained, usually several hours after filling. Immediately after the ladle is drained, cover 70 is again placed in position to hold the interior of the ladle as close to its original temperature as possible until it is refilled, which again may be several hours. In this way, thermal shock to the refactory lining 64 of the ladle is minimized. Furthermore, overall heat loss for both filled and empty trips of the ladle is held to a minimum, with a consequent material saving in energy costs. The protective layers 12 and 13 on cover 70 keep abrasion damage to the blanket surface to a minimum, even though some of the molten metal may solidify at the lip of ladle opening 65, producing irregular edges there. Furthermore, because the ladle is kept at a high temperature even when empty, the tendency of portions of the metal to solidify within the ladle is greatly reduced and the likelihood of a reduction in ladle capacity from this cause is minimized. Blanket cover 70 is light enough so that it can be easily positioned on and removed from ladle 60 by one or more men. There is no need for a crane or hoist to perform this operation.

With continuing use, the protective metallic wool layer 12 will inevitably exhibit some wear. When wear becomes excessive and there is a real likelihood of damage to the central ceramic blanket insulator layer 11, cover 70 may be reversed so that the other protective layer 13 faces the hot molten metal 68. Thus, blanket 70 can be utilized until both of the protective layers 12 and 13 show appreciable deterioration.

A blanket 70 having the described construction has been utilized in a comparative test relative to a conventional ceramic blanket cover protected only by external surface layers of "chicken wire" similar to the backing layer 33 shown in FIG. 4. The conventional blanket having only wire facings required replacement after only approximately every three trips for ladle 60. Blanket 70, on the other hand, was still usuable after twelve trips with only one of the one protective layer 12 having been utilized in facing relation to the molten metal 68; an overall life exceeding twenty trips appeared likely.

Figure 9:
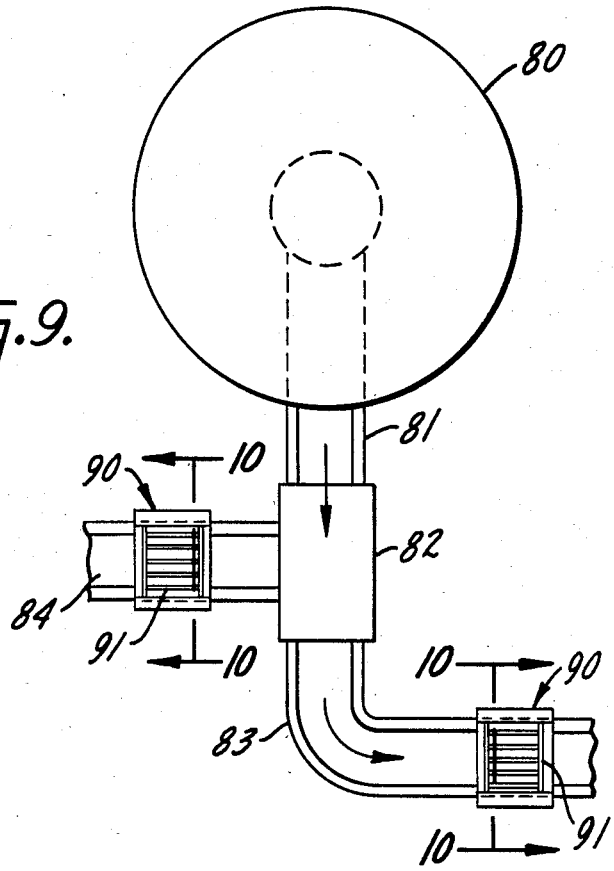
FIG. 9 is a schematic plan view of a blast furnace and the outlet conduits from that furnace, utilizing covers constructed in accordance with another embodiment of the invention.
Figure 10:
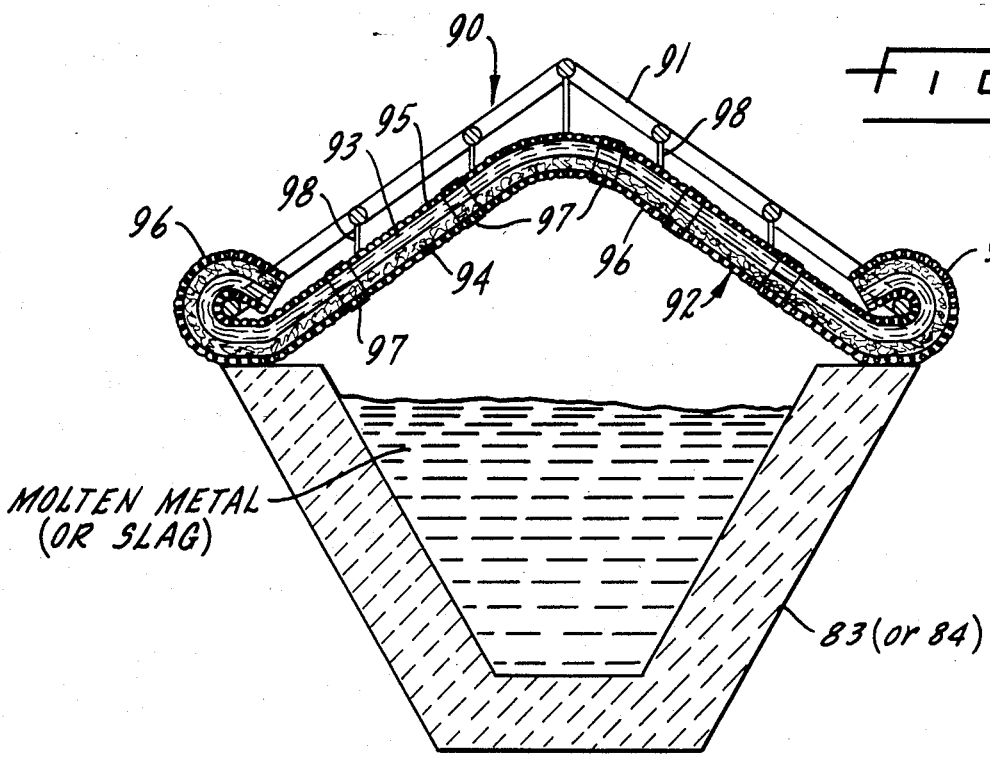
FIG. 10 is a sectional view, taken approximately as indicated by lines 10—10 in FIG. 9, showing the cover construction.

FIGS. 9 and 10 illustrate another application in which a composite insulator blanket constructed in accordance with the invention may be utilized, including a preferred construction for a cover incorporating such a blanket. In the schematic view of FIG. 9, a blast furnace 80 is shown in alignment with a discharge trough 81 which extends to a skimmer 82. Beyond skimmer 82, the molten metal from the blast furnace flows through a runner 83. Slag removed from the metal by skimmer 82 is discharged to a runner 84. When blast furnace 80 is tapped and molten metal is discharged through trough 81, major undesireable emissions occur from trough 81, skimmer 82, and runners 83 and 84 if those conduits are left open to the atmosphere. Furthermore, each of the elements 81–84 of the illustrated system represents a major source of heat loss.

FIG. 9 illustrates two covers 90, one on runner 83 and the other on runner 84. In actual practice, to the extent possible, covers corresponding to the covers 90 would be utilized over the full lengths of trough 81, skimmer 82, runner 83 and runner 84 to reduce emissions and heat loss from all of these elements.

The construction of one of the covers 90 is best illustrated in FIG. 10. As shown therein, cover 90 comprises an open cover frame 91 of metal tubing or rod construction. The principal requirements for frame 91 are that it be light enough in weight to be handled by one or two men, yet relatively rigid so that it affords a stable support for a composite insulator blanket 92. Low weight, for manual handling, can be critical in emergency situations; any cover 90 can be removed immediately when necessary without waiting for a crane or hoist.

Insulator blanket 92, as shown in FIG. 10, includes a principal insulator layer 93 formed of a light weight, flexible, fibrous ceramic blanket material. Insulator layer 93 is faced with a protective layer 94 on the side of the blanket 92 that faces the runner or trough, such as runner 83. Protective layer 94 is a light weight, flexible, fibrous metallic material having a depth many times the thickness of the individual metallic fibers and preferably is a relatively thick layer of high temperature stainless steel metallic wool, monel metal wool, or the like. The outer surface of blanket 92 is a relatively thin protective layer 95 preferably formed of a metallic knit, which may be high temperature stainless steel or monel metal or other metallic material that is highly heat resistant. Blanket 92 is also provided with an auxiliary outer protective layer 96 which, like layer 95, is formed as a knitted or woven fabric of high temperature metallic construction. As in the previously described embodiments, blanket 92 is held together by appropriate fastening means securing the protective layers to the insulator layer 93. This fastening means may comprise a multiplicity of high temperature metallic staples 97, affording a blanket construction corresponding to that described above in connection with FIG. 6. Of course, staples 97 may be replaced by multiple lines of stitching or by a multiplicity of rivets as in other previously described blanket structures.

Cover 90 (FIG. 10) also includes suspension means for suspending insulator blanket 92 from frame 91. The suspension means may constitute a plurality of individual high temperature wire hangers 98 extending downwardly from frame 91 and tied into the upper protective layer 95 on blanket 92 as illustrated. Alternatively, the hangers or other suspension devices 98 may extend completely through blanket 92. In the preferred construction, as illustrated, the outer edges of blanket 92 are extended around the lowermost edges of frame 91 to provide assured thermal protection for the cover frame.

In the utilization of covers like cover 90 (FIG. 10) in an application such as the outlet trough, skimmer, and runners for a blast furnace (FIG. 9) the covers are tailored to provide a continuous covering for all outlet conduits used to convey molten metal and/or molten slag. Continuous covers of this nature greatly reduce the emissions from these conduits, affording a much more acceptable environment for the working personnel of the smelter, foundry, or other facility in which they are employed. With respect to conduits 81–83, covers 90 further afford a major reduction in heat loss; the molten metal is delivered to its destination at a higher temperature with a consequent saving in energy costs. By constructing the covers in a series of individual sections that can be removed and repositioned by one or two men, repair and inspection of the conduits is facilitated, labor costs are minimized, and safety is enhanced.

The use of a support frame like frame 91 is not limited to applications involving covers for open troughs, runners, or the like. Thus, for ladles and other transport vessels, it may be desirable to to provide the flexible insulator blanket of the invention with a light weight metal frame, depending upon the configuration of the particular vessel involved. A cover construction similar to that shown in FIG. 10 may also be used for soaking pits and other storage and processing applications in an iron or steel mill, a foundry, or like facility. Another application for the basic blanket construction is as a wrapping for a closed conduit used in high temperature applications; one such application is as a wrapping for the barrel of a mud gun used to plug the tapping hole of a blast furnace after the furnace has been emptied.

Other applications for the composite insulator blankets of the invention are readily apparent. For example, in facilities that have multi-part rigid covers for vessels or conduits used for transporting or storing molten or near-molten metal, those covers may spring leaks or may develop gaps with continued use. A small section or strip of the protected insulator blanket can then be employed as a gasket or patch for the leaking cover. Another instance of possible use is presented in the case of ingots, billets and castings, or rolled, drawn or forged shapes that must be cooled slowly over long periods of time, conventionally achieved by burying the above shapes in high temperature sand or the like or placing them in insulated covered vessels. Layers of the protected insulator blanket material can be used in a system designed to achieve the desired slow cooling.

We claim:

1. A light weight, flexible, composite insulator blanket capable of extended, repetitive use as a cover or insulator wrapping or gasket for a very high temperature heat source comprising a vessel or conduit employed in transporting, processing, or storing molten or near-molten metal, at temperatures in excess of 1600° F., the insulator blanket comprising:

a principal insulator layer of a light weight, flexible, fibrous ceramic material, subject to deterioration through devitrification and abrasion when subjected to prolonged exposure to a very high temperature heat source;

a protective layer of light weight, flexible fibrous metallic material, covering one surface of the principal insulator layer to a depth many times greater than the thickness of the metallic fibers; and fastening means securing the protective layer to the principal insulator layer at a multiplicity of locations throughout the surface area of the insulator blanket.

2. An insulator blanket according to claim 1 in which the protective layer is of high temperature metallic wool.

3. An insulator blanket according to claim 2 in which the metallic wool is of high temperature stainless steel, monel metal, or both.

4. An insulator blanket according to claim 1 in which the fastening means comprises a plurality of lines of stitching of high temperature metallic wire.

5. An insulator blanket according to claim 4 in which the protective layer is a high temperature metallic wool.

6. An insulator blanket according to claim 5 in which the metallic wool is of high temperature stainless steel, monel metal, or both.

7. An insulator blanket according to claim 4 in which the metallic wire stitching of the fastening means is a high temperature stainless steel.

8. An insulator blanket according to claim 7 in which the protective layer is a high temperature metallic wool.

9. An insulator blanket according to claim 8 in which the metallic wool is of high temperature stainless steel, monel metal, or both.

10. An insulator blanket according to claim 1 in which the fastening means comprises a multiplicity of staples of high temperature metallic wire.

11. An insulator blanket according to claim 10 in which the protective layer is a high temperature metallic wool.

12. An insulator blanket according to claim 11 in which the metallic wool is of high temperature stainless steel, monel metal, or both.

13. An insulator blanket according to claim 10 in which the staples are high temperature stainless steel wire.

14. An insulator blanket according to claim 10 in which the staples are monel metal wire.

15. An insulator blanket according to claim 1 in which the fastening means comprises a multiplicity of rivets of high temperature metal.

16. An insulator blanket according to claim 15 in which the protective layer is a high temperature metallic wool.

17. An insulator blanket according to claim 16 in which the metallic wool is of high temperature stainless steel, monel metal, or both.

18. An insulator blanket according to claim 1 in which the protective layer is a knitted or woven metallic wire material.

19. An insulator blanket according to claim 18 in which the metallic protective layer is formed of high temperature stainless steel wire, monel metal wire, or both.

20. An insulator blanket according to claim 18 in which the fastening means comprises a plurality of lines of stitching of high temperature metallic wire.

21. An insulator blanket according to claim 20 in which the knitted metallic protective layer is formed of high temperature stainless steel wire, monel metal wire, or both.

22. An insulator blanket according to claim 18 in which the fastening means comprises a multiplicity of staples of high temperature metallic wire.

23. An insulator blanket according to claim 22 in which the metallic protective layer is formed of high temperature stainless steel wire, monel metal wire, or both.

24. An insulator blanket according to claim 18 in which the fastening means comprises a multiplicity of rivets of high temperature metal.

25. An insulator blanket according to claim 24 in which the metallic protective layer is formed of high temperature stainless steel wire, monel metal wire, or both.

26. A light weight, flexible, composite insulator blanket capable of extended, repetitive use as a cover or wrapping or gasket for a very high temperature heat source, comprising a vessel or conduit employed in transporting, processing, or storing molten or near-molten metal, at temperatures in excess of 1600° F., the insulator blanket comprising:

a principal insulator layer of a light weight, flexible, fibrous ceramic material, subject to deterioration through devitrification and abrasion when subjected to prolonged exposure to a very high temperature heat source;

two protective layers of light weight, flexible fibrous metallic material, each covering one surface of the principal insulator layer to a depth many times greater than the thickness of the metallic fibers; and fastening means securing the protective layers to the principal insulator layer at a multiplicity of locations throughout the surface area of the insulator blanket.

27. An insulator blanket according to claim 26 in which at least one of the protective layers is a high temperature metallic wool.

28. An insulator blanket according to claim 26 in which each protective layer is a high temperature metallic wool.

29. An insulator blanket according to claim 26 in which one protective layer is knitted or woven metallic fiber material.

30. An insulator blanket according to claim 29 in which the second layer is a high temperature metallic wool.

31. An insulator blanket according to claim 30 in which the metallic wool layer is covered with an additional protective layer of knitted or woven high temperature metallic material.

32. A light weight insulator cover capable of repetitive use of extended duration on a very high temperature heat source comprising a vessel or conduit employed in transporting, processing, or storing molten or near-molten metal, at temperatures in excess of 1600° F., comprising:

an open cover frame of metal tubing or rod;

an insulator blanket;

and suspension means suspending the insulator blanket from the cover frame;

the insulator blanket comprising:

a principal insulator layer of a light weight, flexible, fibrous ceramic material;

a protective layer of light weight, flexible fibrous metallic material, covering one surface of the insulator layer to a depth many times the thickness of the metallic fibers; and fastening means securing the protective layer to the insulator layer;

the insulator blanket being oriented to have its protective layer facing toward the heat source.

33. An insulator cover according to claim 32 in which the protective layer of the blanket is a high temperature metallic wool.

34. An insulator cover according to claim 33 in which the metallic wool is of high temperature stainless steel, monel metal, or both.

35. An insulator cover according to claim 32 in which the fastening means of the blanket comprises a plurality of lines of stitching of high temperature metal wire.

36. An insulator cover according to claim 35 in which the protective layer of the blanket is a high temperature metallic wool.

37. An insulator cover according to claim 32 in which the fastening means of the blanket comprises a multiplicity of staples of high temperature metallic wire.

38. An insulator cover according to claim 35 in which the protective layer of the blanket is a high temperature metallic wool.

39. An insulator cover according to claim 32 in which the fastening means of the blanket comprises a multiplicity of rivets of high temperature metal.

40. An insulator cover according to claim 39 in which the protective layer of the blanket is a high temperature metallic wool.

41. An insulator cover according to claim 32 in which the protective layer of the blanket is a knitted or woven high temperature metallic wire material.

42. An insulator cover according to claim 41 in which the knitted metallic protective layer of the blanket is formed of high temperature stainless steel wire, monel metal wire, or both.

43. A light weight insulator cover capable of repetitive use of extended duration on a very high temperature heat source comprising a vessel or conduit employed in transporting, processing, or storing molten or near-molten metal, at temperatures in excess of 1600° F., comprising;

an open cover frame of metal tubing or rod;

an insulator blanket;

and suspension means suspending the insulator blanket from the cover frame;

the insulator blanket comprising:

a principal insulator layer of a light weight, flexible, fibrous ceramic material;

two protective layers of light weight, flexible fibrous metallic material each covering one surface of the insulator layer to a depth many times the thickness of the metallic fibers; and fastening means securing the protective layers to the insulator layer.

44. An insulator cover according to claim 43 in which at least one of the protective layers of the blanket is a high temperature metallic wool.

45. An insulator cover according to claim 43 in which each protective layer of the blanket is a high temperature metallic wool.

46. An insulator cover according to claim 43 in which one of the protective layers of the blanket is a knitted or woven metallic fiber material.

47. An insulator cover according to claim 46 in which the second layer is a high temperature metallic wool, such second layer facing the heat source.

48. An insulator cover according to claim 43 in which the insulator blanket further comprises a reinforcement layer on the external surface of the second protective layer of the blanket, the reinforcement layer comprising a woven or knitted layer of high temperature metallic wire.

* * * * *